US005533462A

United States Patent [19]

Parsons

[11] Patent Number: 5,533,462

[45] Date of Patent: Jul. 9, 1996

[54] KEEL ARRANGEMENT FOR SAILBOAT HULL

[75] Inventor: Bruce L. Parsons, Portugal Cove, Canada

[73] Assignee: National Research Council of Canada, Ottawa, Canada

[21] Appl. No.: 526,287

[22] Filed: Sep. 11, 1995

[51] Int. Cl.[6] ..... B63B 3/38

[52] U.S. Cl. ..... 114/140; 114/39.1

[58] Field of Search ..... 114/124, 121, 114/128, 140, 144 R, 39.1, 162

[56] References Cited

U.S. PATENT DOCUMENTS 3,324,815 6/1967 Morales ..... 114/39.1
4,686,922 8/1987 Burroughs ..... 114/124
5,313,905 5/1994 Calderon ..... 114/140

*Primary Examiner*—Edwin L. Swinehart

[57] ABSTRACT

The invention provides an improvement in a keel arrangement for a sailboat hull, of the kind having an elongated ballast member spaced below the hull so as normally to extend horizontally and fore-and-aft under the hull, and a front foil and a rear foil depending respectively from a front and a rear portion of the hull, the lower ends of which between them support the ballast member, and in which the rear foil is pivotable about a vertical axis to allow it to act as a rudder. The improvement comprises a joint connecting a main, front portion of the ballast member to a minor, rear portion thereof, the joint allowing both longitudinal and rotational movement between the ballast member portions, whereby the foils can bend independently of each other, and the large majority of drag forces on the ballast member are resisted only by the front foil.

5 Claims, 2 Drawing Sheets

KEEL ARRANGEMENT FOR SAILBOAT HULL

BACKGROUND OF THE INVENTION

1. Field of the Invention

This invention relates to a keel arrangement for a sailboat hull, and particularly a keel arrangement for a high performance yacht, such as the kind of yacht used in races for the America's Cup.

2. Prior Art

Conventional yachts have a fore-and aft ballast member at the bottom of a central keel. Yachts have also been made in which a ballast member is suspended below the hull, at its front and rear ends, by twin foils (also referred to as "wings"), separated by a space. Sometimes the front foil is termed a "keel", while the rear foil, of which at least a part is pivotable about an upright axis, is termed a "rudder", and the whole arrangement may be termed a "tandem keel". Various designs of twin foil or tandem keel arrangements are shown in U.S. Pat. No. 5,313,905, which issued May 24,1994, to Calderon.

The foils used in these keel arrangements may be wholly pivotable about their upright axes, with the foils being connected by bearings to both the hull and the ballast body. Alternatively, a front part of a foil may be made as a fixed strut connecting the hull to the ballast body, and have a pivotable rear flap mounted on this front part. The first arrangement is more efficient hydrodynamically than the second, and the present invention is concerned with designs in which at least the rear foil or rudder (hereinafter referred to only as the "rear foil") is wholly pivotable. However, such designs have the disadvantage that the bearings holding the foils are subjected to considerable stress, since each is taking about one half of all the forces to which the ballast member is subjected. These forces include both hydrodynamic lift and drag forces on the foils and ballast member. Additionally, torque forces also occur in the ballast member caused by differential bending of the front and rear foil. These forces tend to strain the entire arrangement in such a way as to cause the bearings that attach the foils to the ballast member to jam. To date the twin foil yachts which have been built have experienced such large forces on the rear foil that it has not been possible for a helmsman controlling this to detect changing hydrodynamic loads due to the changing rear foil angles of attack used in the process of steering. These unusually large loads require additional mechanical advantage in the steering mechanism, and tend to smother hydrodynamic forces usually conveyed to the helmsman, and make the experience gained in the steering of a sail boat with a detached rudder of little use. Feedback of the hydrodynamic forces from the front foil has also been largely precluded in the known designs.

SUMMARY OF THE INVENTION

This invention provides an improvement in the known twin foil keel systems, of the type using a fully rotational rear foil, which relieves the rear foil from jamming strains and resultant stiffness of movement, and allows this to behave and feel more like a detached rudder. The front foil is also relieved of jamming forces caused by torque forces in the ballast member, and may also thus be more sensitive to hydrodynamic forces.

The present invention accordingly is concerned with a twin foil keel arrangement for a sailboat hull, of the kind having an elongated ballast member spaced below the hull so as normally to extend horizontally and fore-and-aft under the hull, a front foil and a rear foil depending respectively from a front and a rear portion of the hull, each foil having a lower end, which lower ends between them support the ballast member, and means for pivotally mounting at least the rear foil about its axis to allow it to act as a rudder. In accordance with the invention, this known arrangement is modified so that the rear foil is relieved of some major loads. This is achieved by providing joint means connecting a main, forward portion of the ballast member to a minor, rear portion thereof, these joint means allowing both longitudinal and rotational movement between the ballast member portions, whereby the foils can bend independently of each other. The joint means relieves the rear foil of most of the drag forces on the ballast member, and both front and rear foils are relieved of the effects of torque forces in the ballast member. The rear foil is thus made much more sensitive to hydrodynamic forces, and the front foil may also be able to provide hydrodynamic feedback to the helmsman.

The main forward portion of the ballast member is preferably made at least six times as heavy as the said minor rear portion, so that the front foil carries the large majority of the drag forces on the ballast member. This, along with the freedom of the ballast member to twist with differential bending of the front and rear foils, has the effect of restoring, to a considerable extent, feedback of hydrodynamic forces on the boat to the helmsman who is directly controlling the rear foil, as it is experienced in conventional yachts. Placing the joint means close to the rear foil also means that it is in an area where flow is normally turbulent so that the non-streamlined nature of the joint means does not affect overall drag.

The front foil may be entirely pivotable, or it may have a part which is fixed and a part which is capable of pivoting like a rudder.

BRIEF DESCRIPTION OF THE DRAWINGS

The invention will be further described with reference to the accompanying drawings, showing preferred embodiments of the invention, and in which.

DETAILED DESCRIPTION

Figure 1:
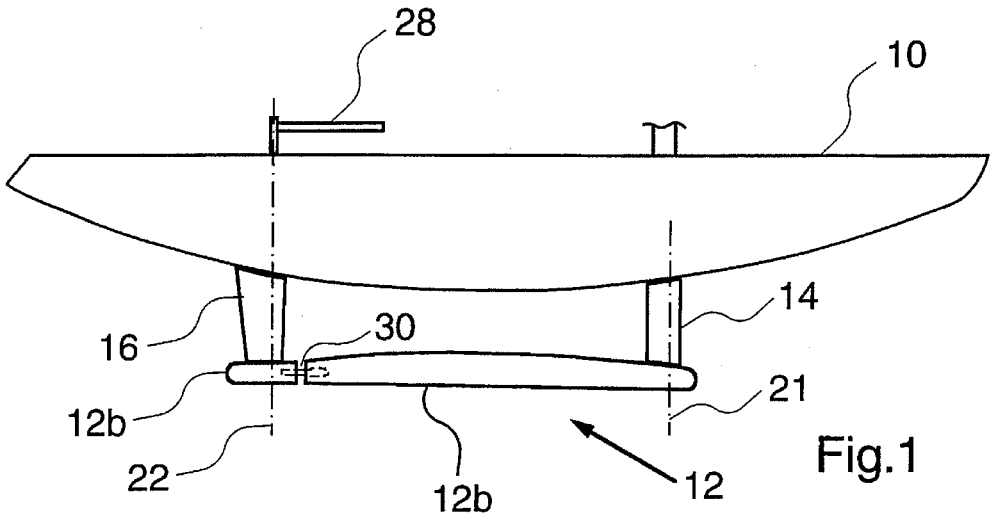
FIG. 1 shows a side elevation of a yacht in accordance with this invention.

FIG. 1 shows a yacht hull 10, of the type which is sometimes referred to as a "canoe" hull, having a keel arrangement which comprises an elongated ballast member or so-called "ballast bulb" 12 spaced below the bottom of the hull by front and rear foils 14 and 16 respectively, the lower ends of which foils support the ballast bulb so that it is normally horizontal and extends fore-and-aft under the hull. Each of the foils is pivotally mounted in the hull, and pivotally connected to the ballast bulb, so as to be pivotal through at least 30° about axes 21 and 22, which are vertical and extend along the foils. The rear foil 16, which is held by vertically aligned bearings 24 and 25 in the hull, and which holds bearing 26 of the ballast bulb, acts as a rudder controlled by tiller 28. The front foil 14 may be pivoted in an opposite rotational direction to that of the rear foil when the yacht is turning, or may be rotated in the same direction of rotation when the yacht is moving straight ahead but is resisting sideways wind forces.

As with conventional rudders, the pivot axis of each of the foils is ahead of the center of pressure on the foils, which is about 25% of the foil chord from the leading edge, and is preferably placed as far ahead as possible. In order for the pivot axis to be in an optimum forward position, the foil has a relatively thick section, i.e. the thickness/chord ratio is 16% or more.

The yacht so far described is similar to that of FIG. 16 of the Calderon patent as aforesaid. As indicated above, a drawback of that design is the jamming of all the bearings holding the foils due to hydrodynamic forces and to the constraint provided by the rigid ballast bulb.

In accordance with this invention, the ballast bulb, instead of being solid as in Calderon and similar designs, is divided into a main, front portion 12*a*, and a minor, rear portion 12*b*. Preferably, the front portion is at least six times the weight of the rear portion, and in practice may have nearly all the ballast bulb weight. These portions are connected by joint means 30, which are designed to maintain alignment between the portions while allowing both longitudinal and rotational movements between the portions. In the "at rest" position, illustrated in FIGS. 1 and 2, with no hydrodynamic forces on the two foils and ballast bulb, a small clearance space C exists between the adjacent ends of the ballast bulb portions.

Figure 2:
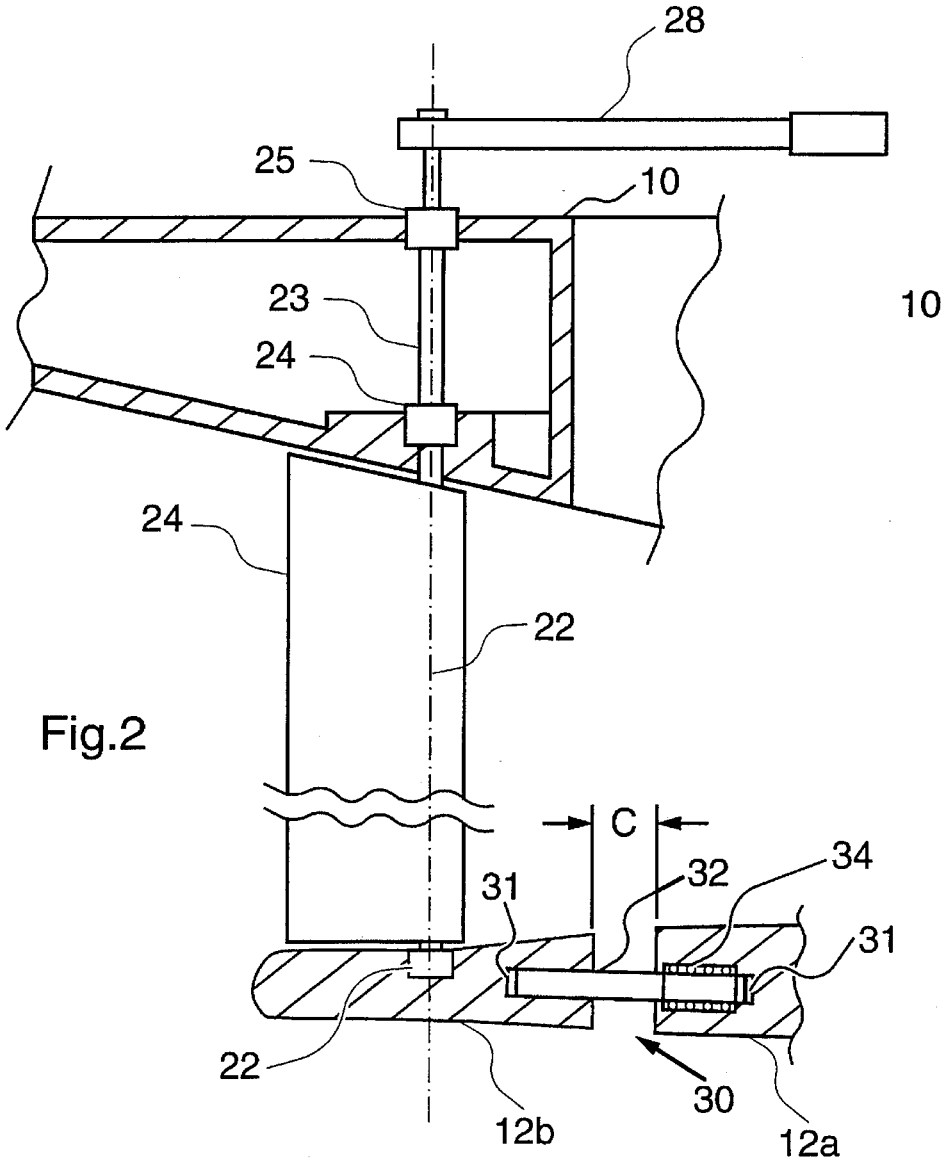
FIG. 2 shows a sectional detail of the structure shown in FIG. 1.

As best shown in FIG. 2, the joint means 30 includes aligned bores 31 in the adjacent ends of the portions 12*a* and 12*b*, parallel to the fore-and aft axis of the ballast bulb, a shaft 32 having a rear part fixed within the bore of the rear ballast bulb portion 12*b*, and a journal type bearing 34 in the bore of the front portion 12*a* which slidably and rotatably receives a front part of the shaft 32. The bearing 34 is provided with ball bearings of a kind in which the balls support the shaft both in rotational and in axial movement. Suitable bearings are those manufactured by Thomson Industries, Inc.

The joint means described relieves the constraint of the rigid ballast bulb, and as such the jamming forces on the bearings carrying the foils. Drag forces on the ballast bulb will cause this to move slightly rearwards, with bending of the front foil, and this movement is accommodated by the clearance space "C". More importantly, the joint means also prevent any torque forces from being transmitted along the ballast bulb. The relief of torque forces allows both front and rear foils to become more sensitive to hydrodynamic forces than in the known design.

The Calderon patent referred to above shows various arrangements for linking the controls of the front and rear foils, so that both foils may be moved simultaneously by a single tiller. However, it is also possible in accordance with this invention to control the front foil independently, while the rear foil is controlled as a rudder by tiller 28.

Figure 3:
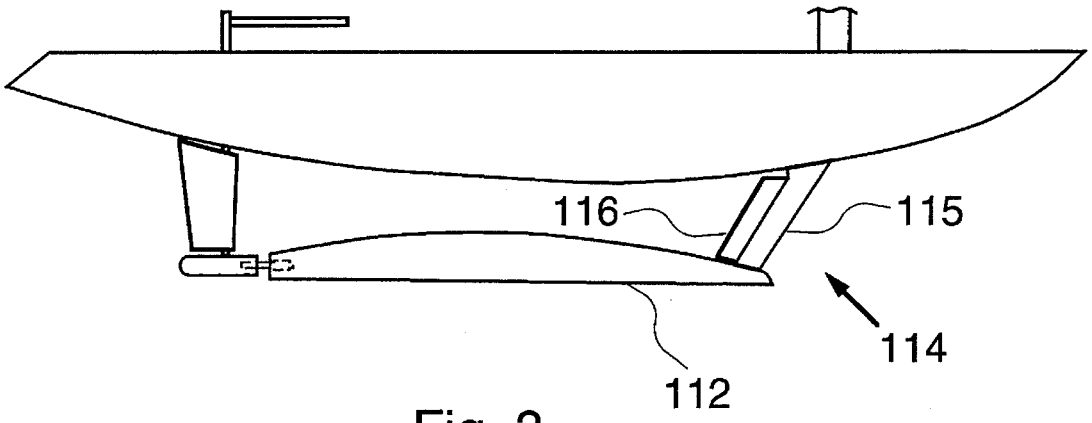
FIG. 3 shows a view similar to FIG. 1 of an alternative construction.

FIG. 3 shows an alternative construction, generally similar to that of FIGS. 1 and 2, but different in that the front foil 114 includes a solid strut 115 and a movable rear flap 116. While somewhat less hydrodynamically efficient than the rotatable foil 14, this solid strut does have the advantage of strength for resisting the drag forces to which the front foil is subjected, while the flap remains easily moved.

I claim:

1. In a keel arrangement for a sailboat hull, said keel arrangement having;

an elongated ballast member spaced below said hull so as normally to extend horizontally and fore-and-aft under said hull, a front foil and a rear foil depending respectively from a front and a rear portion of the hull, each foil having a lower end, which lower ends between them support said ballast member, means for pivotally mounting at least the rear foil about an axis extending along said rear foil to allow it to act as a rudder;

the improvement comprising joint means connecting a main, front portion of said ballast member to a minor, rear portion thereof, said joint means allowing both longitudinal and rotational movement between said ballast member portions, whereby said foils can bend independently of each other.

2. The improvement according to claim 1, wherein at least a part of the front foil is capable of pivoting about an axis extending along said front foil.

3. The improvement according to claim 1, wherein said joint means includes a shaft extending longitudinally of the ballast member from one of said ballast member portions into a journal bearing held by the other of said ballast member portions, said journal bearing having ball bearings means.

4. The improvement according to claim 1, wherein said joint means is positioned in an area of the ballast member where flow is normally turbulent.

5. The improvement according to claim 1, wherein the main front portion of the ballast member is at least six times as heavy as the said minor rear portion.

* * * * *